US011511284B2

(12) United States Patent
Stetsiouk

(10) Patent No.: US 11,511,284 B2
(45) Date of Patent: Nov. 29, 2022

(54) PIN MILL

(71) Applicant: Vasili Stetsiouk, Phoenix, AZ (US)

(72) Inventor: Vasili Stetsiouk, Phoenix, AZ (US)

( * ) Notice: Subject to any disclaimer, the term of this patent is extended or adjusted under 35 U.S.C. 154(b) by 137 days.

(21) Appl. No.: 17/216,467

(22) Filed: Mar. 29, 2021

(65) Prior Publication Data

US 2021/0213457 A1 Jul. 15, 2021

Related U.S. Application Data

(63) Continuation-in-part of application No. 16/732,288, filed on Dec. 31, 2019, now Pat. No. 11,338,299.

(51) Int. Cl.

| | |
|---|---|
| ***B02C 13/22*** | (2006.01) |
| ***B02C 13/286*** | (2006.01) |
| ***B02C 13/288*** | (2006.01) |
| ***B02C 13/284*** | (2006.01) |

(52) U.S. Cl.

CPC ..... *B02C 13/22* (2013.01); *B02C 13/286* (2013.01); *B02C 13/288* (2013.01); *B02C 2013/28672* (2013.01)

(58) Field of Classification Search

CPC ..... B02C 13/22; B02C 13/286; B02C 13/288; B02C 13/284; B02C 2013/28672

See application file for complete search history.

(56) References Cited

U.S. PATENT DOCUMENTS 3,620,463 A * 11/1971 Feder ..... B02C 7/06 241/261
2019/0283034 A1* 9/2019 Berry ..... B02C 13/18
2021/0022289 A1* 1/2021 Berry ..... B02C 13/16

* cited by examiner

*Primary Examiner* — Adam J Eiseman
*Assistant Examiner* — Mohammed S. Alawadi

(57) ABSTRACT

A pin mill includes a rotor plate mounted on a shaft and having concentrically spaced-apart circular arrays of pins arise from an end face. The rotor pins interdigitate with complementary concentric arrays of pins arising from a face of a stator mounted on a door. The door swings open on a hinge mounted on two translator pins so that the door can translate the interdigitated pins before swinging open so that the pins arrays do not collide with each other while the door is opening. The rotor operates within a rotatable cylindrical screen which retains particles being broken up until they are small enough to exit. The rotor includes a circular array of vane knives which sweep closely within the screen and also entrain cooling air into the macerating volume of the mill. Oversized particles trapped in the screen also get cleared and split apart by the passing vane knives.

19 Claims, 13 Drawing Sheets

SECTION X-X

SECTION Y-Y

B – B

B – B

PIN MILL

COPYRIGHT STATEMENT

A portion of the disclosure of this patent document contains material that is subject to copyright protection. The copyright owner has no objection to the facsimile reproduction by anyone of the patent document or the patent disclosure as it appears in the Patent and Trademark Office patent file or records, but otherwise reserves all copyright rights whatsoever.

CROSS REFERENCE TO RELATED APPLICATION

This application is a continuation in part application of U.S. Utility application Ser. No. 16/732,288 "Pin Mill" filed 31 Dec. 2019. The entire contents of U.S. Utility application Ser. No. 16/732,288 "Pin Mill" filed 31 Dec. 2019 is hereby incorporated into this document by reference.

FIELD

The invention relates to milling machines for disintegrating biological matter into fine powders or slurries.

BACKGROUND

Mills are used for crushing, macerating, and shredding of biological materials to make medicines, seasonings, and fertilizers, where bulk storage, handling, or processing of powders, granulated or pelletized materials, or pastes and slurries may be more convenient and effective than if these materials were made available in larger flakes, chunks, or larger pieces.

BRIEF DESCRIPTION

A pin mill includes a rotor plate mounted on a shaft and having concentrically spaced-apart circular arrays of pins arise from an end face. The rotor pins interdigitate with complementary concentric arrays of pins arising from a face of a stator mounted on a door. The door swings open on a hinge mounted on two translator pins so that the door can translate the interdigitated pins before swinging open so that the pins arrays do not collide with each other while the door is opening.

Materials to be processed may be fed into a hopper connected to a conduit directing the material to enter into a disintegrating volume of the inventive machine. The materials are rapidly macerated and broken into finer sized particles between rotating and stationary sets of pins within the disintegrating volume. The rotor operates within a cylindrical screen which retains particles of the materials being broken up within the disintegrating volume of the machine until they are small enough to exit.

The rotor also includes a circular array of vane knives which sweep closely within the screen and split apart particles stuck in the screen that are too large to pass through. The vane knives also include aerodynamic features which entrain cooling air into the macerating volume of the mill. The inflowing air clears particles trapped in the screen, and the vane portions of the vane knives impel particles trapped or resting at the periphery back into the active disintegrating zone where rotating pins pass closely by stationary pins. The vane knives thus refresh the screen by repeatedly clearing its apertures.

Thus a primary objective of the invention is to provide a pin mill for disintegrating material to fine particle sizes by macerating in-fed material between closely-spaced rotating and stationary pins. A corollary objective of the invention is that this disintegrating operation is accomplished quickly and with minimal noise or vibration. In the case of foodstuffs or the processing of biological matter, another corollary objective of the invention is to avoid undesirable heating of the materials in process to prevent cooking or chemical alterations such as denaturing of proteins by in-process heat.

Another objective of the invention is to produce milled material which is uniform in particle size to the extent that such uniformity is achievable.

Yet another objective of the invention is that the mill is easily cleaned, which includes affording convenient access to moving and stationary parts, and convenient ability to expose these parts to effective cleaning methods such as directed streams of water or cleaning fluids which can displace and remove material particles between operations. A corollary objective of the invention is to provide efficacy whereby component surfaces are designed to expose microorganisms to cleansing or sterilizing agents used to clean the mill.

In devices used to process foodstuffs or medicinal matter, it is undesirable for components or component assembly interfaces to act as pores, blind apertures, deep cracks or crevices, or to offer surfaces which accumulate or retain biofilms which in any way impede or impair exposure of cleaning or sterilizing agents to microbial cells present within the machine.

BRIEF DESCRIPTION OF THE DRAWINGS

A further understanding of the nature and advantages of particular embodiments may be realized by reference to the remaining portions of the specification and the drawings, in which like reference numerals are used to refer to similar components. When reference is made to a reference numeral without specification to an existing sub-label, it is intended to refer to all such multiple similar components.

DETAILED DESCRIPTION OF CERTAIN EMBODIMENTS

Figure 1:
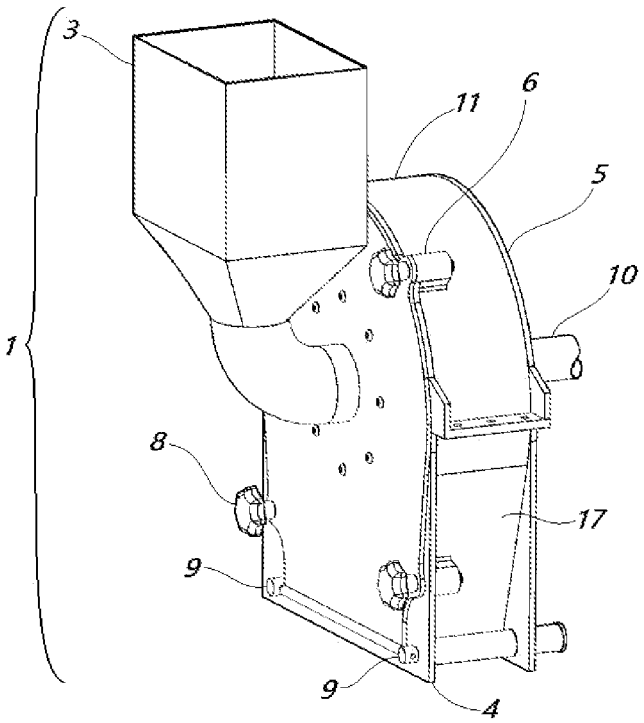
FIG. 1 shows an oblique, front top right external view of a pin mill in accordance with the invention, having an attached hopper.

While various aspects and features of certain embodiments have been summarized above, the following detailed description illustrates a few exemplary embodiments in further detail to enable one skilled in the art to practice such embodiments. The described examples are provided for illustrative purposes and are not intended to limit the scope of the invention.

In the following description, for the purposes of explanation, numerous specific details are set forth in order to provide a thorough understanding of the described embodiments. It will be apparent to one skilled in the art, however, that other embodiments of the present invention may be practiced without some of these specific details. Several embodiments are described herein, and while various features are ascribed to different embodiments, it should be appreciated that the features described with respect to one embodiment may be incorporated with other embodiments as well. By the same token, however, no single feature or features of any described embodiment should be considered essential to every embodiment of the invention, as other embodiments of the invention may omit such features.

In this application the use of the singular includes the plural unless specifically stated otherwise, and use of the terms "and" and "or" is equivalent to "and/or," also referred to as "non-exclusive or" unless otherwise indicated. Moreover, the use of the term "including," as well as other forms, such as "includes" and "included," should be considered non-exclusive. Also, terms such as "element" or "component" encompass both elements and components comprising one unit and elements and components that comprise more than one unit, unless specifically stated otherwise.

The phrase "operably coupled" and its derivative phrases such as "for operably coupling," when used such as "[A] is operably coupled to [B]" means that when [A] is operated then [B] is caused to operate. The operation of [B] in response to [A] may incorporate but not be limited to a direct relation, a proportional relation, or an inverse relation, and time delays may be designed in between the actuation of device or controller [A] and the behavior of [B.] The phrase "[A] is operably coupled to [C] by means of [B]" means that [A] is operably coupled to [B] and [B] is operably coupled to [C,] so that the intermediate component or system [B] may act as a modulating influence on the operation of component or system [C] in response to actuations of device or controller [A.] The operation of [C] in response to [A] may incorporate but not be limited to a direct relation, a proportional relation, or an inverse relation. Time delays may be incorporated between [A] and [B] or between [B] and [C] or both between [A] and [B] and between [B] and [C.]

The invention relates to milling machines for breaking down materials into homogenized batches of evenly sized particles. Milling may include cutting, crushing, shearing, and macerating material introduced between moving and stationary features.

FIG. 1 shows an oblique, front top right external view of a pin mill [1] in accordance with the invention, which is a disintegrating mill having an attached infeed hopper [3.] In the embodiment shown, the hopper attaches to a duct communicating with an infeed aperture in an access door for closing the housing aperture, which in turn communicates to the interior of the housing.

The components for disintegrating incoming material operate within a milling volume within a housing that defines an interior. The housing has a first plate [4] which is a front plate, and a second plate [5] which is a rear plate. The milling volume is also enclosed by a perimeter wall spanning between the first plate and the second plate, with the perimeter wall having an arcuate section [11] and a gap below which is an aperture that allows milled material to exit the milling volume, fall through an exit hopper, and leave the machine. The exit hopper in this embodiment includes lower portions of the front and rear plate and planar, sloped sections [17] of the perimeter housing. The housing has an access door which is shut against the housing by knobs [8] which thread into threaded holes in ears [6] on the housing. The housing has hinge pins which attach to the ends of extendable guide bars [9] that are slidingly received into guide tubes affixed to the housing. Rotating components within the mill volume are driven by a drive or rotor shaft [10] seen extending out of the rear plate.

The interior passage of these guide tubes is also called a lumen, and when more than one tube is present on the housing, round lumina and round tubes may be employed to receive round bars as guide bars. However, the housing may also include only one guide tube if its lumen is not axially symmetrical, and a complementary guide bar inserted into the lumen is shaped so as not to rotate therein. Examples of such configurations include but are not limited to an angle channel received within lumen of a complementary shape or a minimal polygon circumscribing the cross section of the angle channel; other simpler examples include polygon bars fitted to slide inside polygon lumina, such as a square bar received within a square lumen or a hexagonal bar received within a hexagonal lumen. Such polygons may be regular or irregular. In all these examples a single guide bar may support a door pinned or otherwise hingeably coupled to such a guide bar for closing the aperture in the first plate of the housing. However, in the figure shown, the guide bars are two round bars and these slide into round tubes having round lumina.

Figure 2:
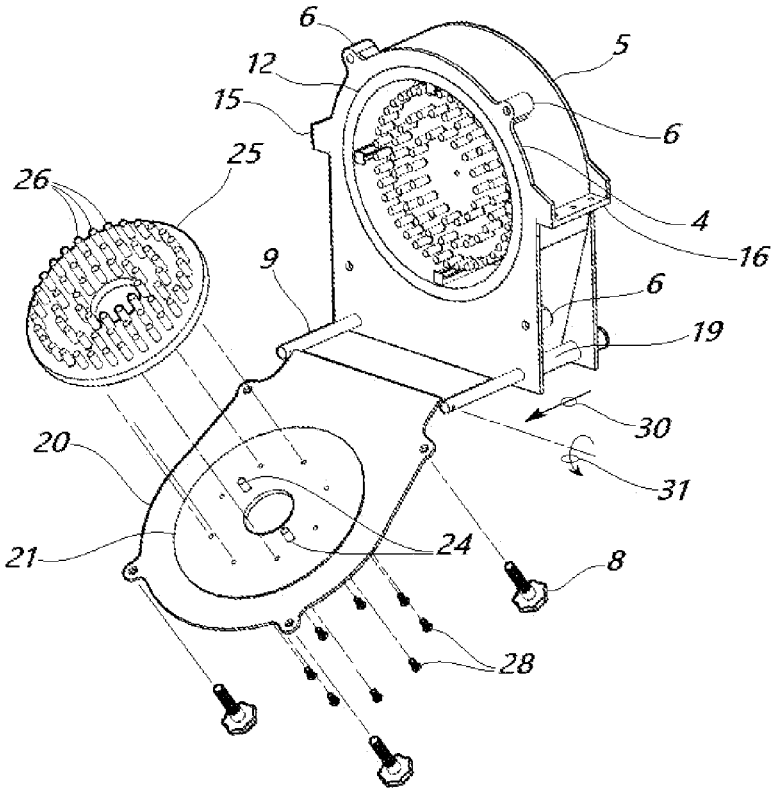
FIG. 2 shows the pin mill of FIG. 1 with its access door extended and swung away, and components normally attached to the access door exploded for discussion.

FIG. 2 shows the pin mill of FIG. 1 with its access door extended and swing away, and components normally attached to the access door exploded for further view and discussion. In this view the access door [20] is shown pulled away on its guide bars [9] which reside within guide tubes [19.] The access door is shown swung away to reveal a disc which is a stator [25] affixed to the access door. The stator comprises a plurality of radially spaced apart circular arrays of projections [26] which in this embodiment are round bars or pins having a cross section which is a circle. Other cross sections for these projections which reside within the scope of the invention include regular and irregular polygons, diamonds, triangles, circles, ovoids, ellipses, squares, rectangles, rhombuses, trapezoids, segments of a cylinder, and segments of a hollow cylinder, including cross sections equivalent to these shapes but having rounded, chamfered or filleted apices or corners, or rounded edges and end faces of the projections may also include rounded edges or fully rounded end faces.

A stator which is a disc having round rods and entirely machined from a single mass of material is a preferred embodiment compared to a plate to which individual pins are pressed or otherwise attached, because discrete pins affixed to a rotor disc would allow microbes to migrate and reside between these parts, reducing efficacy of cleaning or sterilizing agents when the mill is cleaned between batches. Fastening pins onto a blank plate would leave crevices beneath the pins where microbes could get in and contaminate batches of foodstuffs.

By eliminating cracks and crevices wherein microbes may elude sanitizing processes, the opportunity for a colony of unwanted bacteria to become established and contaminate successive batches of materials is reduced.

The stator disc mounts to the inside of the door by means of threaded fasteners [28,] and locator pins [24] accurately align the stator and its features to the rotor assembly of the invention when the door is closed.

In the embodiment shown interior surface of the housing door also includes a round boss or cylindrical surface [21] complementary to an inside diameter a cylindrical screen sized [12] to fit within the housing, so that when the door is closed and secured, this boss supports one end of the screen. The door may be secured shut against the housing by knobs [8] which thread into threaded holes in ears [6] on the housing. The housing has a first plate [4] which is a front plate, and a second plate [5] which is a rear plate. The housing also provides mounting bars [16] for secure mounting in a facility such as with fasteners securing the mill and its motor to an equipment frame.

The disintegrating mill has a shaft-driven rotor assembly which comprises a rotor disc which defines a second axis of rotation and like the stator also includes a plurality of radially spaced apart circular arrays of projections. Also as with the stator, a preferred embodiment for these projections uses round bars or pins. Other cross sections for these projections which reside within the scope of the invention include regular and irregular polygons, circles, rectangles, segments of a cylinder and segments of a hollow cylinder. Again like the stator, a rotor which is a disc having round rods and entirely machined from a single mass of material is a preferred embodiment compared to a plate to which individual pins are pressed or otherwise attached, for the same reasons of efficacy mentioned above.

With the aperture in the first plate closed by the door and with the stator attached and accurately located to the door by its locating pins, the first plurality of radially spaced apart circular arrays of projections emerging from a face of the rotor disc interdigitate with and radially alternate with the second plurality of radially spaced apart circular arrays of projections emerging a face of the stator disc. Proceeding in a radial direction, the stationary circular arrays of projections or pins on the stator radially alternate with rotating circular arrays of projections or pins on the rotor. The plurality of circular arrays of projections or pins on the rotor are concentric with each other, and the plurality of circular arrays of projections or pins on the stator are also concentric with each other, so that with the door closed the sets of rotor pins become concentric with the stator pins within an assembly tolerance. The narrower the clearances between the rotor pins and the stator pins, the finer the particle size of materials will be when they pass through the passages between the moving and stationary components of the mill.

Because the stator and rotor pins interdigitate closely and deeply with each other, if the door hinges were fixed to the housing, the swinging action of opening the door would cause the stator pins hung on the door to collide with the rotor pins and prevent the door from opening. Therefore, the housing instead provides door guides [19] for the door to first translate the stator pins apart from the rotor pins in a translation motion indicated by arrow [30] to disengage them before rotating the door on its hinges about a rotation axis shown by arrow [31.]

The door for closing the aperture in the housing is hingeably attached to an end of at least one door guide bar, which in turn is slidingly coupled to at least one door guide affixed to the housing. In this embodiment the door guide bars are two rods each having a transverse hole made at one end for a hinge pin to pass through and couple the door to the pin so that the door may swing about the axis defined by the coaxial set of hinge pins. The door guides are two round tubes which having round lumina each define a translation axis for the lateral motion of the door while the stator pins are interdigitated with the rotor pins. Thus the invention provides a mechanism for translating the door away from the housing first, before swinging the door by rotation at its hinge pins. The hinge axis is supported by one or more guide bars which slide in guides mounted on the housing.

Figure 3:
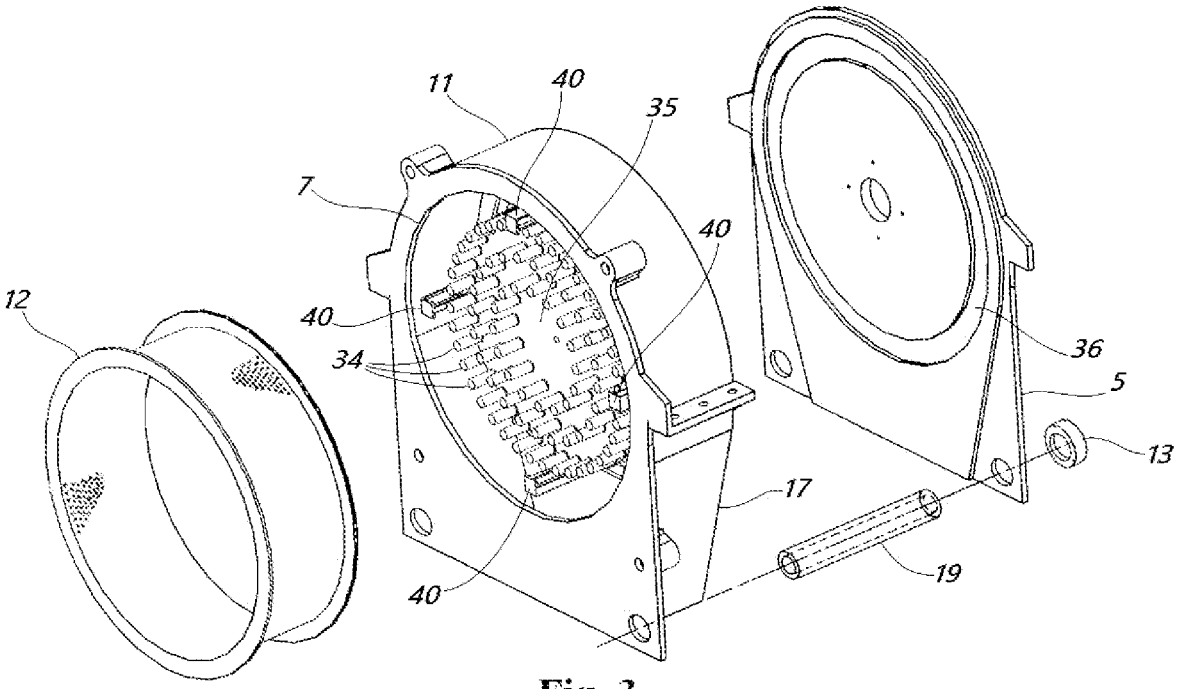
FIG. 3 shows the pin mill of FIG. 1 with its access door omitted, and interior screen axially exploded, and a rear plate exploded to reveal various features and components.

FIG. 3 shows the pin mill of FIG. 1 with its access door omitted, an interior screen axially exploded, and a rear plate exploded to reveal various features and components of the housing and some parts of the rotor assembly. The housing has a first plate with an aperture [7] for receiving a screen [12] deposited within the housing, and a second plate having a central hole for the drive shaft and a circular groove [36] facing the interior of the housing. The aperture in the first plate is complementary to the outer rim of the flange of the screen. The screen is a cylindrical screen with an inside diameter and with flanges at both its ends, and the circular groove of the second plate [5] of the housing includes a cylindrical surface complementary to the inside diameter of the screen, so that the flange or end face of a portion of the screen is received within the circular groove, and the cylindrical surface of the second plate supports that end of the screen. The other end of the screen nearest the aperture in the housing is supported by the circular boss of the door of the housing as explained in FIG. 2.

The housing includes a perimeter wall spanning between the first plate and the second plate, with the perimeter wall having an arcuate section [11] and a gap below which is an aperture that allows milled material to exit the milling volume, fall through an exit hopper, and leave the machine. The exit hopper in this embodiment includes lower portions of the front and rear plate and planar, sloped sections [17] of the perimeter housing. A door guide [19] spans between the first plate and the second plate of the housing. In this embodiment the door guide is a round tube which has a round lumen and as explained elsewhere this housing includes more than one such door guide. The door guide tubes also include caps [13] which reduce the opportunity for foreign matter to become entrained within them, which eases regular cleaning.

The rotor assembly includes a rotor disc [35] which defines an axis of rotation and which includes a plurality of radially spaced apart circular arrays of projections [34,] and the rotor disc has a perimeter to which are affixed a set of vane knives [40.] The radial extent of the vane knives is selected so that the rotor assembly in motion resides within the inside diameter of the cylindrical screen deposited within the interior of the housing, and the vane knives preferably pass closely within the inner surface of the screen.

The mill may be run between 1500 rpm and 28000 rpm, and chunks, large flakes, or gobbets of matter such as animal meats and organs or plant matter is fed in through the hopper shown in FIG. 1. The material to be processed gets macerated between the moving and stationary pins of the rotor and stator, and the vane knives [40] pass close by to sweep and slice up particles stuck in the pores of the screen so that smaller sub-particles may pass through, and thus reduce clogging of the peripheral screen.

The vane knives include airfoil sections which develop suction in passing by the screen which may advantageously pull at matter stuck in the pores of the screen. Matter dislodged from the screen in this manner is drawn back into the active macerating zones between the moving and stationary pins. The vane knives also entrain air into the mill to keep temperatures cool and prevent cooking or heating of natural or organic matter being processed. The vane knives actions combine screen cleaning and induction of cooling air allowing this machine to process materials up to 8 times faster than other machines similar in size and processing volume.

Figure 4:
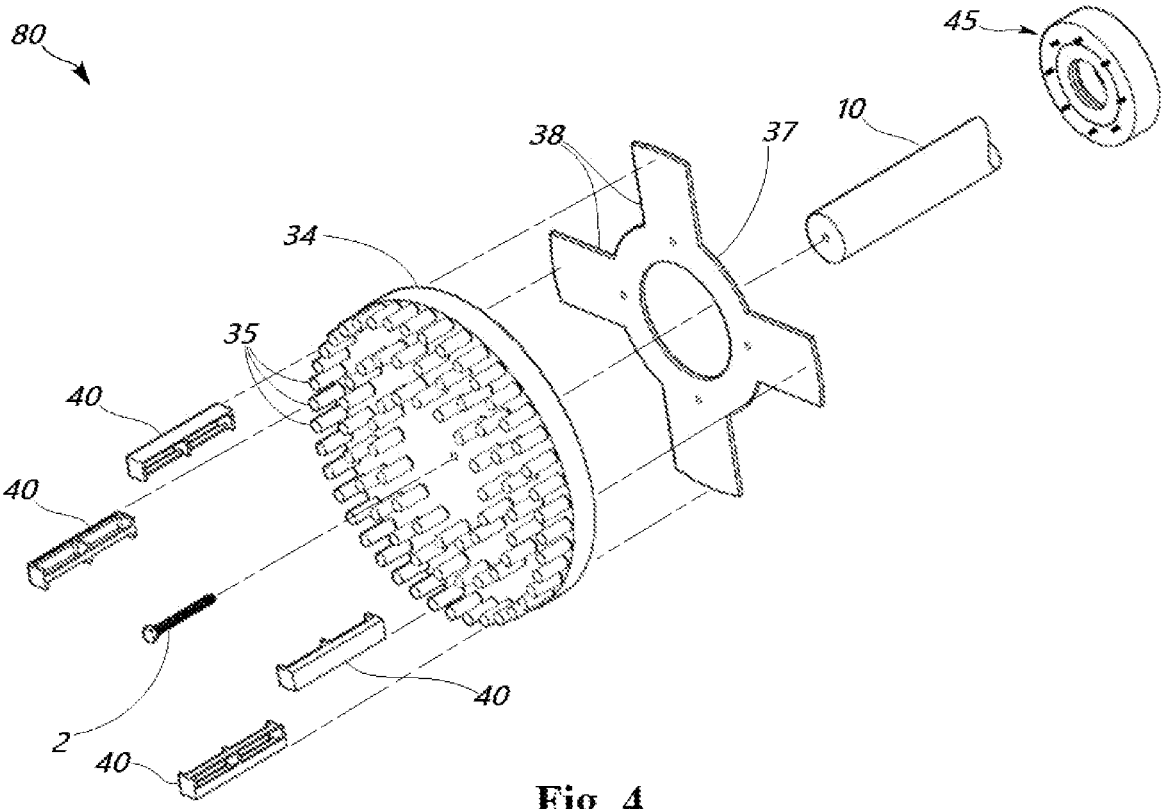
FIG. 4 shows an exploded view of the rotary components of the pin mill of FIG. 1, and a rear shaft seal assembly.

FIG. 4 shows an exploded view of the rotary components of the pin mill of FIG. 1, and a rear shaft seal assembly [45.] The rotor assembly [80] has a drive shaft [10] with its axis of rotation and a rotor disc [34] having pluralities of radially spaced apart circular arrays of projections [35] emerging from the disc and extending in an axial direction. A threaded fastener [2] such as a bolt attaches the rotor disc to the shaft.

At least one vane knife is attached to the perimeter of the rotor disc. Three to six vane knives distributed evenly along the circumference of the disc are preferred, with the embodiment shown having four vane knives [40] attached to the disc perimeter in quadrature. In the event that only one vane knife is used, having the rotor assembly include a counterbalancing mass diametrically opposite the vane knife is advisable.

The rotor disc has an obverse face and a reverse face, and the vane knives project axially forward from the obverse face of the rotor disc to an extent substantially similar to the projection dimension of the macerating pins.

The vane knives also extend axially rearward beyond the reverse face of the rotor disc. Rather than leave these portions cantilevered with no support, the rotor disc includes a hub extending abaft from its reverse face and a back plate [37] affixed to the hub. Arms [38] of the back plate extend radially from the hub and attach to and support the rear cantilevered portions of the vane knives. Cooling air and macerated material may circulate in the large toroidal volume of air defined between the hub, the reverse face of the rotor disc, the second plate of the housing, and the inner surface of the screen as regularly swept by the vane knives.

Figure 5:
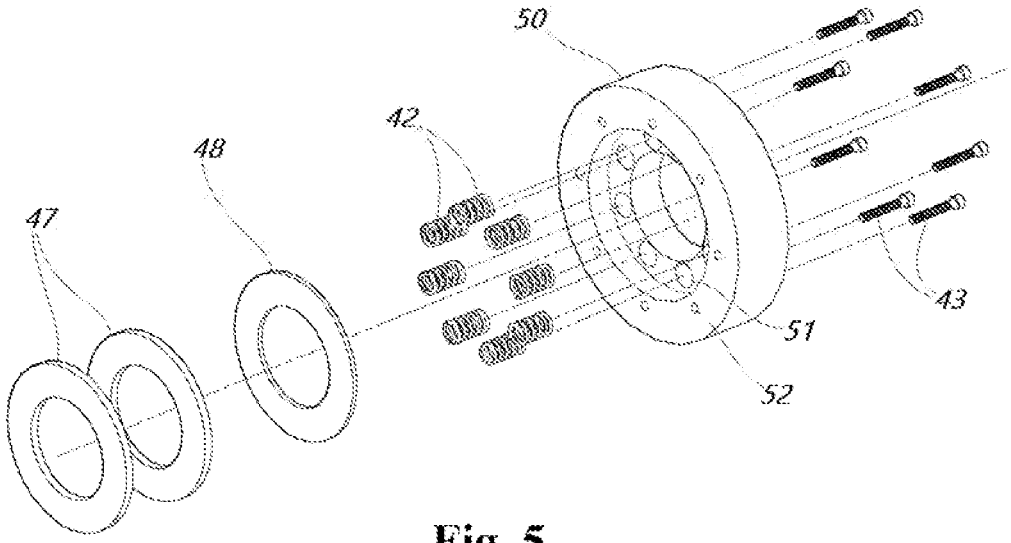
FIG. 5 shows an exploded view of components of a shaft seal for a pin mill in accordance with the invention.

FIG. 5 shows an exploded view of components of a shaft seal for a pin mill in accordance with the invention. The rotor assembly is attached to the shaft passing through the shaft seal and a shaft aperture in the housing. The shaft seal is an assembly including a shaft seal bezel [50] having a bore closely matched to the shaft diameter, an inward facing counterbore and a plurality of blind apertures [51] which retain compression springs [42.] A circular pattern of through holes [52] receives fasteners [43] for securing the bezel to the outside of the second plate of the housing. The circular array of compression springs press a pressure plate [48] against two axially stacked shaft seals [47.] Stainless steel (SST) for the pressure plate and Teflon® or polytetrafluoroethylene (PTFE) for the shaft seals are preferable materials. The two PTFE seals are pressed together by SST washer spring-loaded from the end of the shaft seal bezel.

The axial stack of seals and the pressure plate is statically indeterminate and the first of the two PTFE seals may rotate with respect to the housing, the second of the two PTFE seals may rotate with respect the first seals, the SST pressure plate may rotate with respect to the second PTFE seal, and any, all, or none of these components may rest independently upon the drive shaft, and may rotate independently at any speed between zero and the rotational speed of the drive shaft.

Figure 6A:
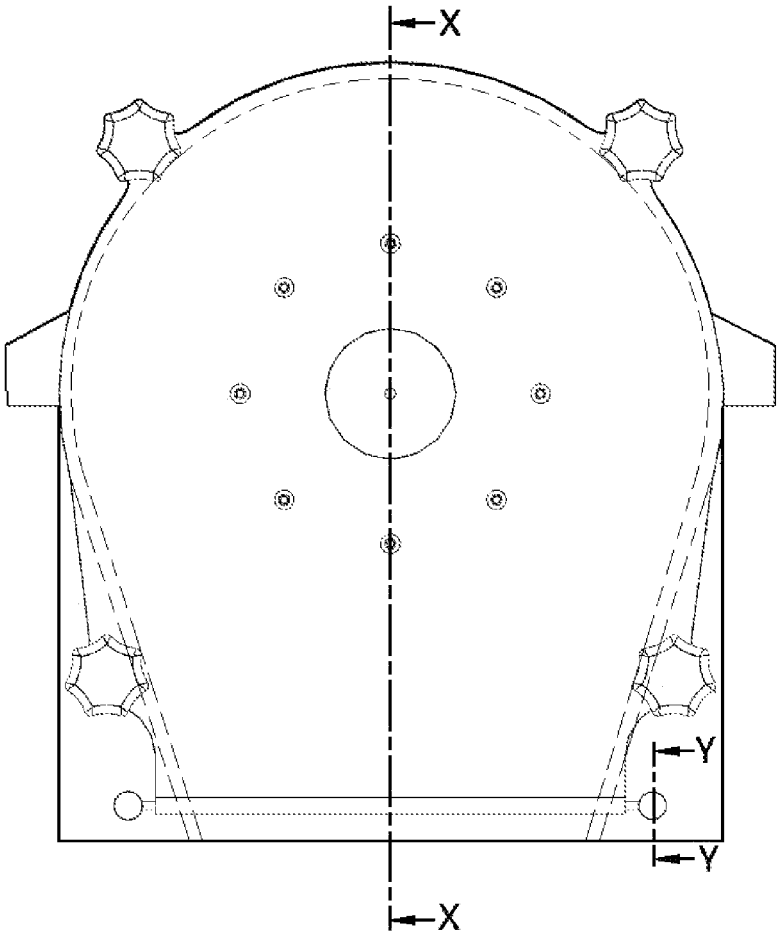
FIG. 6*a* is a front view of the pin mill of FIG. 1, defining section lines X-X and Y-Y for the cross section views FIGS. 6*b* and 6*c*.
Figure 6B:
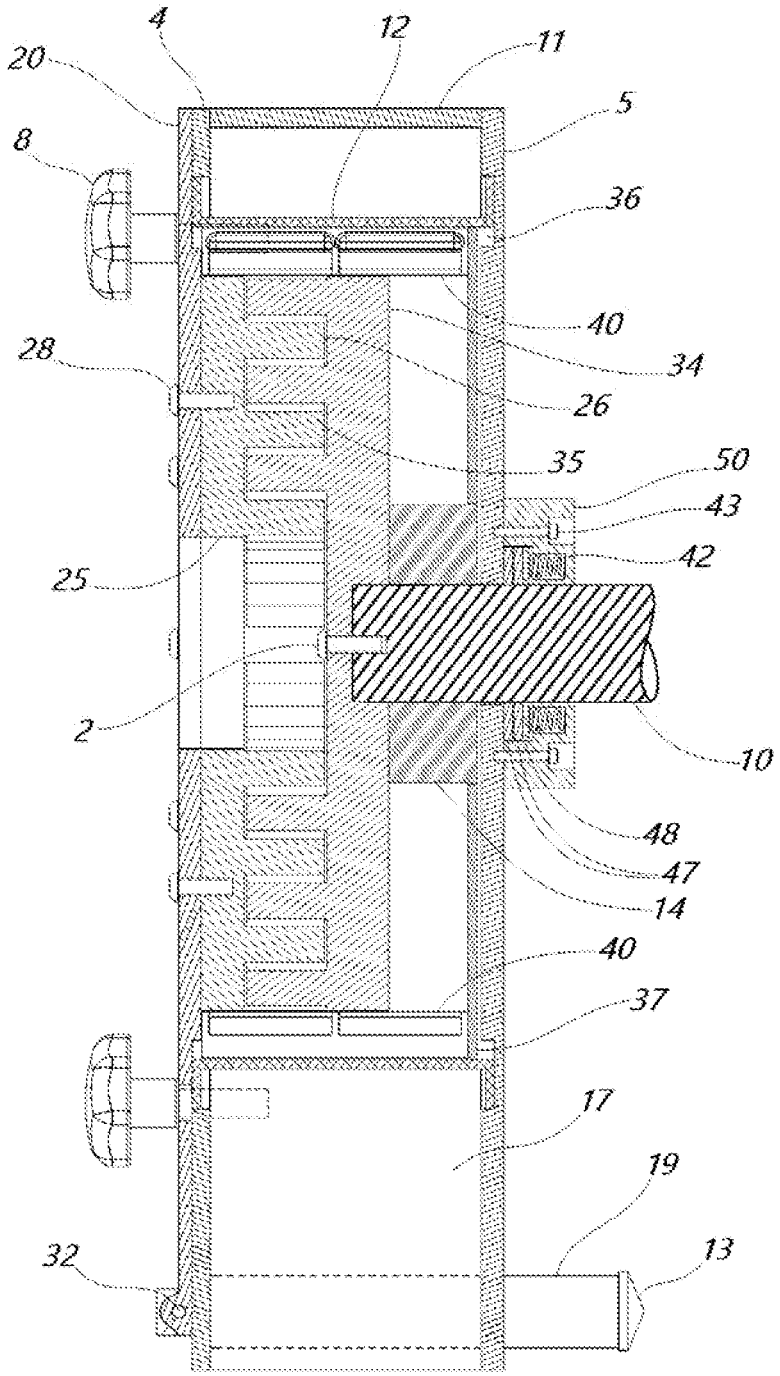
FIG. 6*b* is a cross section view of the pin mill of FIG. 1 taken at section line X-X shown in FIG. 6*a*.
Figure 6C:
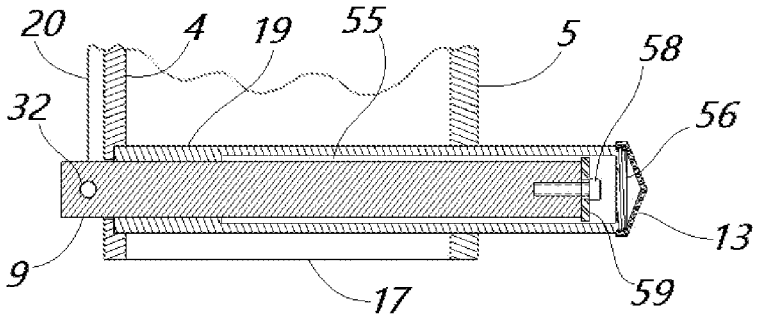
FIG. 6*c* is a cross section view of a door guide assembly of a pin mill in accordance with the invention, taken at section line Y-Y shown in FIG. 6*a*.

FIG. 6*a* is a front view of the pin mill of FIG. 1, defining section lines X-X and Y-Y for the cross section views FIGS. 6*b* and 6*c*.

FIG. 6*b* is a cross section view of the pin mill of FIG. 1 taken at section line X-X shown in FIG. 6*a*. The housing comprises a first or front plate [4] and a second or rear plate [5,] and perimeter wall having an arcuate section [11] and a gap below which is an aperture that allows milled material to exit the milling volume. The aperture is bounded in part by sloped, planar surfaces [17] which are part of an exit hopper. The housing includes a door [20] which is secured shut to the housing by knobs [8.]

A cylindrical screen [12] fits closely around a stator disc and a rotor assembly inside the housing. The screen has flanges so that it is supported and its end faces are sealed by the front and rear plates to define and enclose a milling volume. The rotor assembly and the stator reside within this milling volume, because the rotor assembly resides within the inside diameter of the screen.

The front plate has a boss which fits inside the inner diameter of the screen, and the rear plate has a circular groove [36] which receives at least a portion of the flange of the screen. The cylindrical surface in the rear plate which supports the screen may be in contact with the inner cylindrical surface of the screen or alternatively may be in contact with the outer perimeter of the flange of the screen. At the door end of the housing, the screen may be supported by a boss in the door which conforms to the inner cylindrical surface of the screen or alternatively the screen may be supported at its outer flange by contact with the rim of the aperture in the front plate of the housing.

Also extending between the front plate and the back plate are door guide tubes [19] which slidingly receive door guide bars. The door is pinned to the end of the door guide bars by at least one hinge pin which passes through a transverse hole or aperture [32] in the guide bars. The guide tubes include caps [13] which exclude dirt.

A drive shaft [10] passes through a central aperture in the second plate for rotating the rotor assembly attached to it by a fastener [2,] and the interconnection between the rotor assembly and the drive shaft may optionally include a keyway and keyseat. A shaft seal assembly includes a shaft seal bezel [50] having a bore closely matched to the shaft diameter, and an inward facing counterbore with a plurality of blind apertures which retain compression springs [42.] A circular pattern of through holes receive fasteners [43] for securing the bezel to the outside of the second plate of the housing. The circular array of compression springs press a pressure plate [48] against two axially stacked shaft seals [47.]

The rotor assembly includes a rotor disc [34] having pluralities of radially spaced apart circular arrays of projections [35] emerging from the disc and extending in an axial direction. The rotor disc also has a plurality of vane knives [40] affixed along its perimeter. The rotor disc includes a hub [14] extending abaft from its reverse face and a back plate [37] affixed to the hub. Arms of the back plate extend radially from the hub and attach to and support the rear cantilevered portions of the vane knives.

The stator disc [25] mounts to the inside of the door by means of threaded fasteners [28,] and includes a plurality of radially spaced apart circular arrays of projections [26.] The stationary circular arrays of projections or pins on the stator radially alternate with rotating circular arrays of projections or pins on the rotor. The plurality of circular arrays of projections or pins on the rotor are concentric with each other, and the plurality of circular arrays of projections or pins on the stator are also concentric with each other, so that with the door closed as shown in this cross section, the sets of rotor pins become concentric with the stator pins within an assembly tolerance. The tips of the stator pins clear the obverse face of the rotor disc by an assembly tolerance, and the tips of the rotor pins clear the obverse face of the stator disc by an assembly tolerance.

FIG. 6*c* is a cross section view of a door guide assembly of a pin mill in accordance with the invention, taken at section line Y-Y shown in FIG. 6*a*. Housing features or components seen in this view include a first plate [4,] a second plate [5,] and an exit hopper section [17] of the housing which in this embodiment is a planar membrane extending between the first and second plates. The door [20] is hingeably coupled to at least one door guide bar [9] by a hinge pin received within an aperture [32] at a first end of the guide bar. Although a door guide bar may be a channel or polygon as disclosed above, in a preferred embodiment a door guide bar is a round bar.

The guide bar is slidingly received within a lumen [55] of a guide tube [19.] When pulling the door to translate it laterally before swinging the door on its hinge axis, it is preferable to arrange that the guide bar is stopped from pulling free of the guide tube. An extension stop feature may be included as part of the guide bar or the guide tube. In the embodiment shown in this figure an extension stop is configured by including a deep counterbore in the tube slightly larger than the diameter of the bar which acts as a guide bar, and including a washer [59] slightly larger than the diameter of the guide bar yet sized to travel laterally within the long counterbore. The washer is affixed to a second end of the guide bar with a fastener [58] so that it may travel within the counterbore section of the lumen of the guide tube but will stop short of allowing the guide bar to be pulled out of the tube entirely. The constricted remainder of the lumen of the guide tube is selected to be sufficient to stabilize the translation of the door bars and the door without cocking or jamming. In this embodiment the finite depth of the counterbore functions as the door guide comprising an extension stop. Alternatively, interfering features such as a flange or ear at the second end of the door guide bar or the affixed washer in this figure function as the door guide bar incorporating an extension stop. Lastly in this figure, the guide tube includes a cap [13] that attaches to threads [56] at the end of the guide tube to exclude dirt or foreign matter.

Figure 7A:
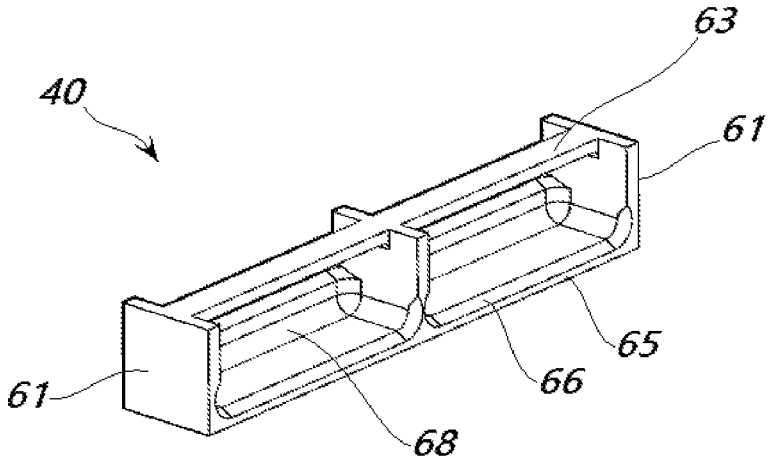
FIG. 7*a* shows an oblique view of an embodiment of a vane knife for a pin mill in accordance with the invention.

FIG. 7*a* shows an oblique view of an embodiment of a vane knife [40] for a pin mill in accordance with the invention. The vane knife includes first and second end plates [61] and a midplate, all connected by a keel [63] or spine member for spacing these plates apart rigidly. The vane knife includes features which allow it to act as an airfoil which in motion generates pressure on features facing toward the axis of rotation of the rotor assembly, and vacuum on the opposite side of its chord. For a vane knife acting as an airfoil, a surface facing the axis of rotation of the rotor assembly is a pressure surface, and a surface on the opposite side of the chord acts as a suction surface.

The embodiment of a vane knife shown in this figure includes a blunt leading edge [65] and an angled cutting edge [66,] and a curved portion [68] of the surface facing toward the axis of rotation when this vane knife is affixed to the perimeter of a rotor disc acts as a pressure surface. The blunt leading edge of this particular design impacts and shears through particles stuck in the screen and may pull the obstructive portions of these particles clear of the screen by the vacuum produced in its wake. By this action the vane knife is able to clean the screen or alternatively force the shorn off portions of plugged particles through the screen and out of the mill once they have been sized by extrusion through the pores of the screen.

Figure 7B:
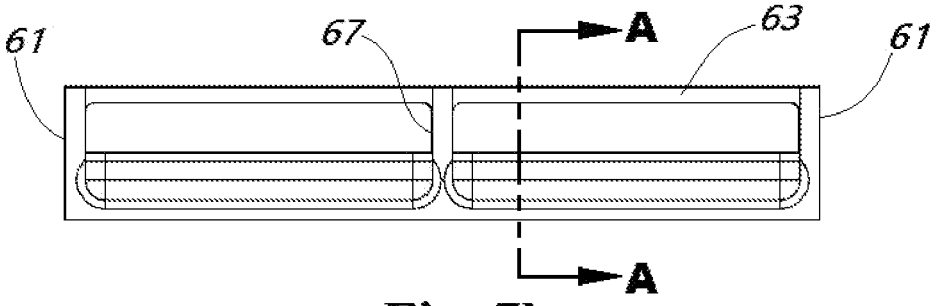
FIG. 7*b* shows a side view of the embodiment of a vane knife of FIG. 7*a*, also defining a section line A-A for the cross section views FIGS. 7*d* and 7*e*.
Figure 7C:
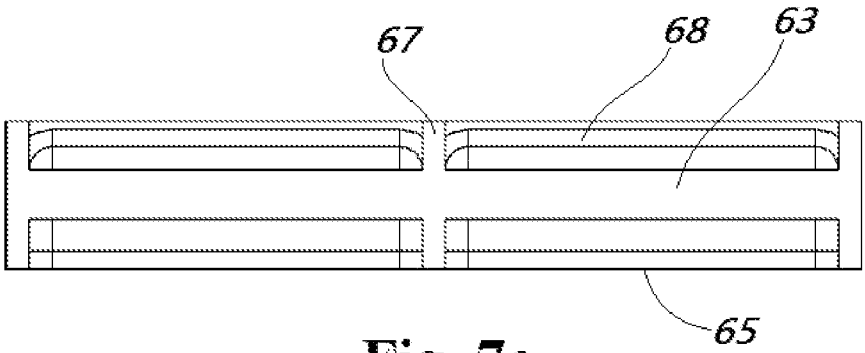
FIG. 7*c* shows a top view of the embodiment of a vane knife of FIG. 7*a*.
Figure 7D:
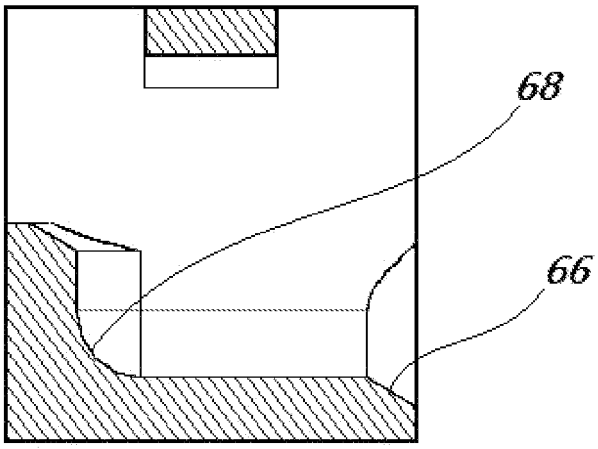
FIG. 7*d* is a cross section view of the vane knife of FIG. 7*a* taken at section line A-A shown in FIG. 7*b*.
Figure 7E:
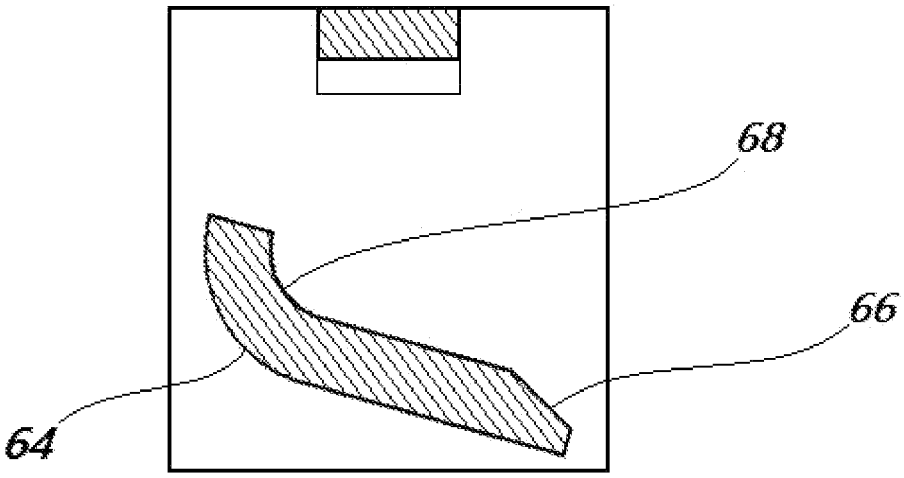
FIG. 7*e* is a cross section view of an alternate embodiment of a vane knife in accordance with the invention, taken at section line A-A shown in FIG. 7*b*.

FIG. 7*b* shows a side view of the embodiment of a vane knife of FIG. 7*a*, also defining a section line A-A for the cross section views FIGS. 7*d* and 7*e*. This view also shows the first and second end plates [61] and a midplate [67] all connected by a keel [63] or spine member for spacing these plates apart rigidly.

FIG. 7*c* shows a top view of the embodiment of a vane knife of FIG. 7*a*. The spine [63] rigidly connects the end plates to the midplate [67] and the blunt leading edge is perpendicular to this view. The curved surface [68] deflects air and broken off particles shorn off and cleared from the screen towards the viewer in this view.

FIG. 7*d* is a cross section view of the vane knife of FIG. 7*a* taken at section line A-A shown in FIG. 7*b*. This view shows the knife edge or cutting edge [66] portion of the airfoil and a curved pressure surface [68] deflecting airflow and particles toward the center of the milling volume. The back side of this airfoil section creates suction in its wake.

FIG. 7*e* is a cross section view of an alternate embodiment of a vane knife in accordance with the invention, taken at section line A-A shown in FIG. 7*b*. The cutting edge [66] is sharper as it approaches material to be shaven from the inside cylindrical surface of the screen. The pressure surface of this airfoil includes both the inclined, planar surface facing the axis of rotation of the rotor assembly, and the negatively curved surface [68] near the trailing edge of the airfoil chord. The curved surface opposite the negatively curved portion of the pressure surface is a positively curved surface [64] on the back side of the airfoil chord near its trailing edge. The suction surface of this airfoil includes both this positively curved surface and the planar surface on the back sided of the airfoil beginning at its leading edge. The angle of attack of this chord section develops aggressive suction for clearing clogged pores of the screen and for pulling stuck particles clear and impelling them inward to the milling volume where they may be further broken down into sizes fit to exit through the screen.

Figure 8A:
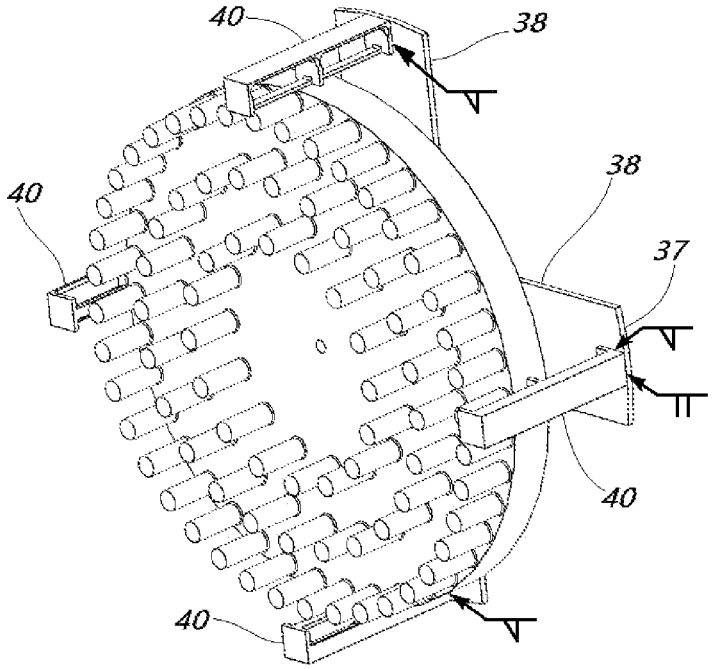
FIG. 8*a* is an oblique, front top right view of a rotor assembly for a pin mill in accordance with the invention.

FIG. 8*a* is an oblique, front top right view of a rotor assembly for a pin mill in accordance with the invention. In the assembly shown, four vane knives [40] are welded to the perimeter of the rotor disc in quadrature. Rotation of the disc is clockwise when viewing the face of the rotor disc having pins, which is its obverse face. The weldment incorporates the midplanes of the vane knives for additional strength and rigidity. The rotor assembly includes a back plate [37] welded or otherwise affixed either to the shaft or to a hub portion of the rotor disc extending abaft of the reverse face of the rotor disc, which is opposite its obverse face. Support arms [38] of the back plate extend radially and attach to and support the rear cantilevered portions of the vane knives. In this embodiment the arm ends act as tabs and the vane knives are welded to the tabs using a butt weld along the distal edge of the support arm where it is substantially flush with the vane knife, and three fillet welds around rest of the end plate of the vane knife where it is in contact with the face of the support arm. These welds are shown by generic weld symbols recognizable within ANSI (American National Standards Institute) and AWS (American Welding Society) where portions of the edges of the vane knife end plate are visible in this figure.

Figure 8B:
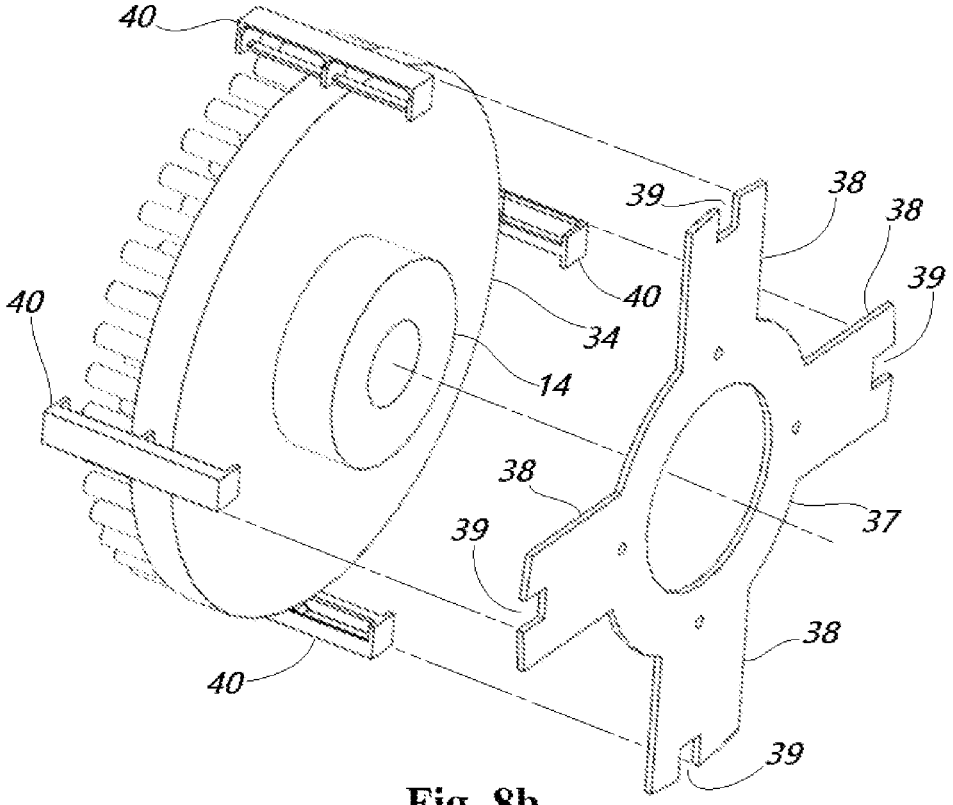
FIG. 8*b* is an oblique, rear top right view of the rotor assembly shown in FIG. 8*a*, with an alternate embodiment of a rotor back plate shown exploded away from the other components.

FIG. 8*b* is an oblique, rear top right view of the rotor assembly shown in FIG. 8*a*, with an alternate embodiment of a rotor back plate shown exploded away from the other components. The vane knives [40] are welded to the perimeter of the rotor disc in quadrature. The rotor disc [34] includes a hub [14] extending abaft from its reverse face and a back plate [37] affixed to the hub, such as by a weldment. Arms [38] of the back plate extend radially from the hub and attach to and support the rear cantilevered portions of the vane knives. In this embodiment shown, the distal edges of the arms each include cutouts [39] which receive the end plates of the vane knives. Each end plate may be welded into the cutout using a butt weld on the three sides contained by the cutout of the arm.

Figure 8C:
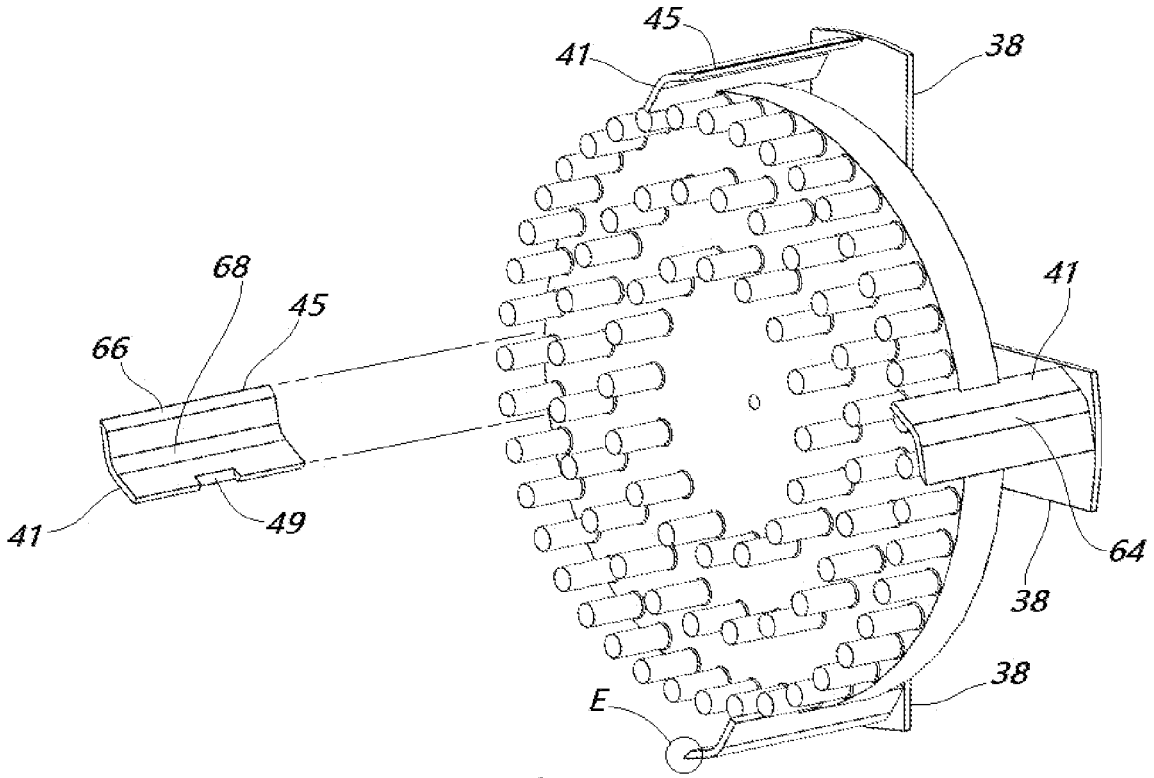
FIG. 8*c* is an oblique, front top right view of an alternate embodiment of a rotor assembly for a pin mill in accordance with the invention, having vane knives of an alternate embodiment also in accordance with the invention, and with one of these vane knives exploded in a forward direction relative to the other components.

FIG. 8*c* is an oblique, front top right view of an alternate embodiment of a rotor assembly for a pin mill in accordance with the invention, having vane knives [41] of an alternate embodiment also in accordance with the invention, and with one of these vane knives exploded in a forward direction relative to the other components. The rotor assembly further comprises a back plate [38] axially spaced apart from the rotor disc, and for each vane knife the back plate comprises an arm extending radially and attached to the vane knife.

The vane knives of this embodiment define an airfoil including a leading edge [45] which is a cutting edge residing radially beyond the perimeter of the rotor disc. The airfoil includes a pressure surface facing toward the axis of rotation of the rotor assembly, and a suction surface opposite from the pressure surface. The pressure surface includes a negatively curved surface [68] and the suction surface includes a positively curved surface [64.] The beveled portion [66] of the edge assists in defining the leading edge of the vane knife as a cutting edge for shearing material clogging the pores of the screen residing just beyond the swept volume of the vane knives. These vane knives include cutouts [49] in their trailing edges where they are welded to the perimeter of the rotor disc.

Figure 9:
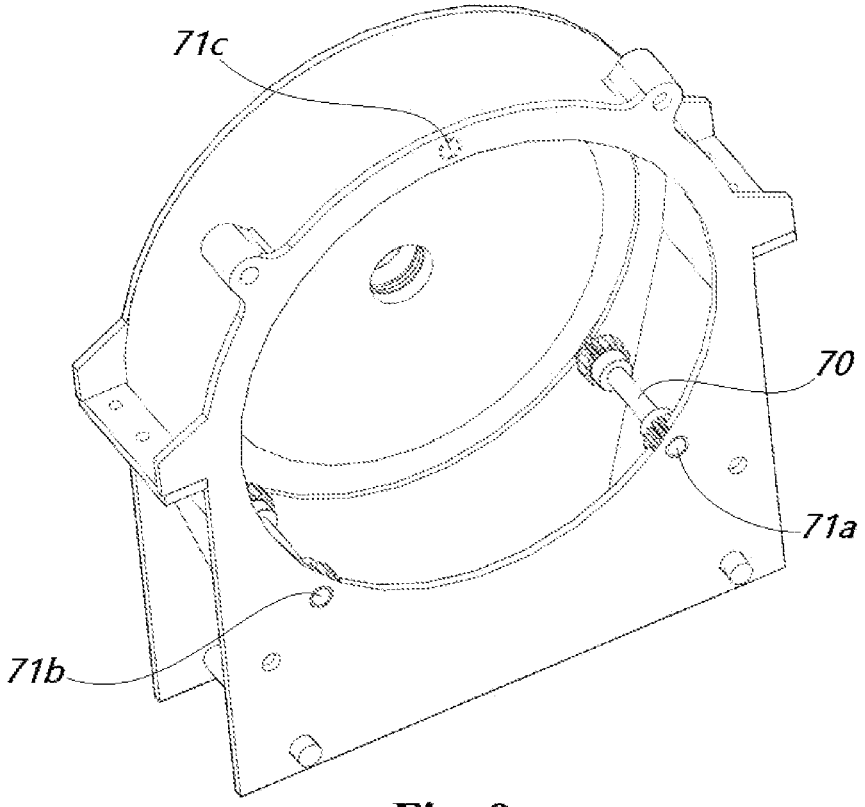
FIG. 9 shows an oblique, front top left view of an embodiment of a housing for a pin mill in accordance with the invention in which the screen is a rotatable screen.

FIG. 9 shows an oblique, front top left view of an embodiment of a housing for a pin mill in accordance with the invention in which the screen is a rotatable screen. The housing includes at least one drive spindle [70] rotatably mounted within the housing which engages with the screen to rotate it while the mill is operating. The rotating screen catches broken up material falling from the macerating action of the rotor and stator pins, which is yet too large to pass through the pores of the screen. Rotation transports this material to an elevated location where it falls free from the screen and falls back into the active disintegrating zone of the rotor and stator pins. It is preferred to locate a least one drive spindle to contact the lower half portion of a circular flange of the rotating screen, and even better to include more than one spindle to support the screen by its flanges, such as at "4-o'clock" and "8-o'clock" locations along the flange circumference. Another preferred pair of locations are "4:30" and "8:30" locations along the flange circumference. In degree references, a plane passing through the rotational axis of the screen and the rotational axis of a spindle subtends an angle preferably between 30° and 45° from a vertical plane. It is also within the scope of the invention to include a spindle at the "6-o'clock" location to support the screen. In the embodiment shown, a drive spindle [71*a*] is located at a "4:30" location 45° to the right of the bottom center of the arc of the housing aperture as viewed from the front, and an idler spindle [71*b*] is located at the "8:30" location, or 45° to the left of bottom center, and an optional idler [71*c*] may be included at the "12-o'clock" location or the top center of the arc of the housing of the housing aperture. It is only necessary to provide drive rotational power to any one spindle and have the rest be idlers. The spindles may be coupled to the housing by means of bearings or bushings.

Figure 10A:
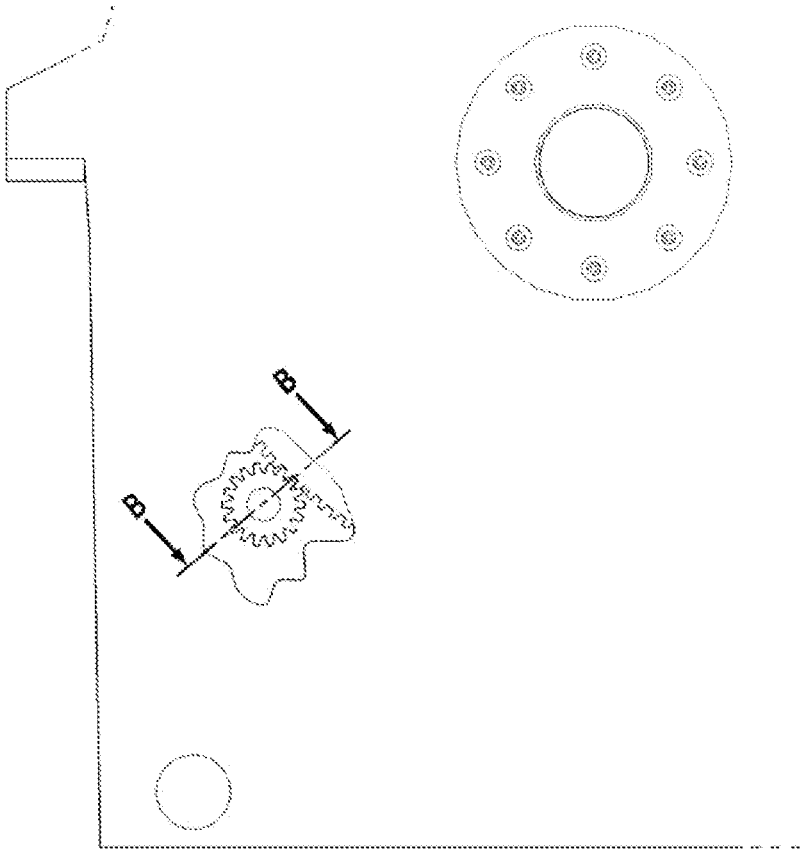
FIG. 10*a* shows a rear view of the embodiment of FIG. 9, including a partial broken view to reveal a geared drive spindle, and defining a section line B-B for the cross section views of FIGS. 10*c* and 10*g*.
Figure 10B:
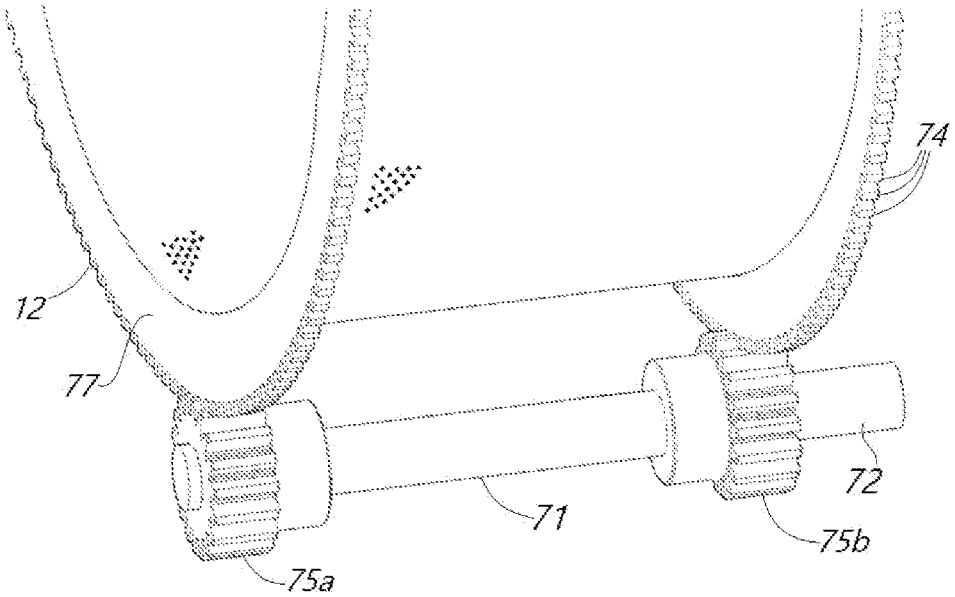
FIG. 10*b* shows an oblique right front view of a portion of a rotatable screen engaged with a geared spindle which is a geared drive shaft.
Figure 10C:
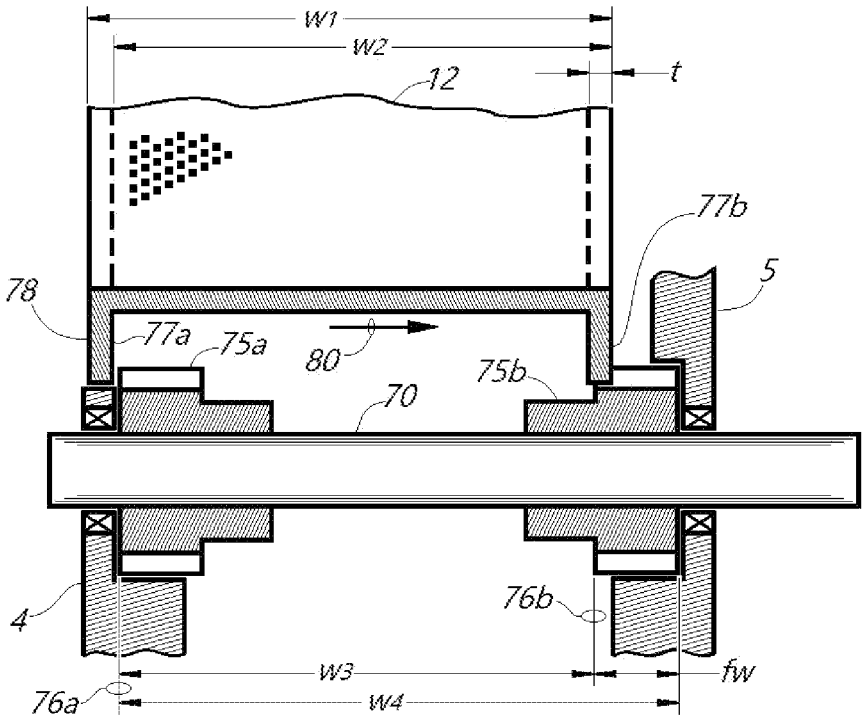
FIG. 10*c* shows a cross section view of a portion of a rotatable screen in being installed in its housing and engaging with a geared shaft in accordance with the invention, taken at section line B-B defined in FIG. 10*a*.
Figure 10D:
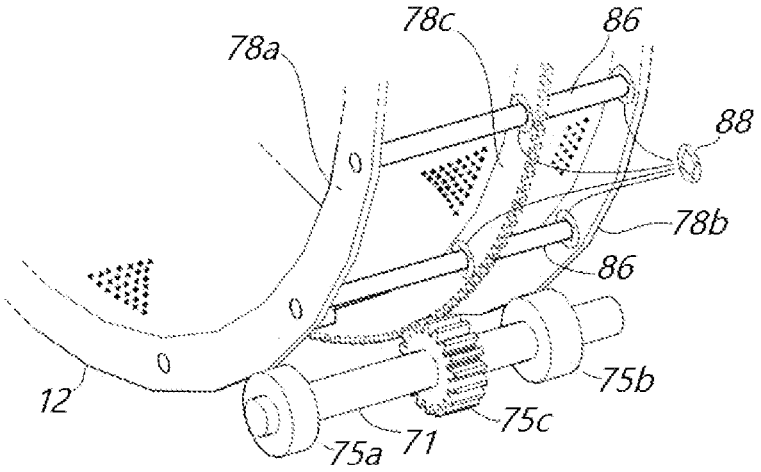
FIG. 10*d* shows an oblique right front view of a portion of an embodiment of a rotatable screen having a plurality of flanges, engaged with an alternative embodiment of a drive spindle which comprises both rollers and a gears as rotatable surfaces which rotate the screen.

FIG. 10*a* shows a rear view of the embodiment of FIG. 9, including a partial broken view to reveal a geared drive spindle, and defining a section line B-B for the cross section views of FIGS. 10*c* and 10*d*.

FIG. 10*b* shows an oblique right front view of a portion of a rotatable screen [12] engaged with a geared spindle which is a geared drive shaft. Although it is possible to rotate the screen by means of a friction drive system, with a smooth or textured rotatable surface of the drive spindle in contact with a smooth or textured rotatable surface of the screen, in a preferred embodiment more positive means of operably coupling rotation of the drive spindle [71] with rotation of the screen include the use of spur gears [75*a*, 75*b*] or splines on the drive spindle engaging with complementary gear teeth [74] or splines on the screen. The rotatable screen further has a first circular array of teeth on its front flange [77] and the drive spindle has a second circular array of teeth on its front gear [75] engageable with the first circular array of teeth on the flange of the screen. An extension portion [72] of the drive spindle shaft extends out of the aperture where it may be coupled to a motor drive. Although meshed teeth of the screen and drive spindle are shown, it is also within the scope of the invention to couple rotation of the spindle with rotation of the screen by means of a belt or silent chain.

FIG. 10*c* shows a cross section view of a portion of a rotatable screen [12] being installed in its housing and engaging with a geared shaft [70] in accordance with the invention, taken at section line B-B defined in FIG. 10*a*. The screen has a first flange [78] with first edge [77*a*] on a first flange face which faces away from the aperture in the front plate [4] of the housing, and a second flange [77*b*] with a second edge [77*b*] on a second flange face which also faces away form the housing aperture when installed. The overall width of the screen is a dimension [w1,] and the first and second flange edges are axially spaced apart from the first edge by a first distance [w2.] The drive spindle has a first drive surface on a first gear [75*a*] which has a first edge [76*a*] and a second drive surface on a second gear [75*b*] having a second edge [76*b*] axially spaced apart from the first edge by a second distance [w3.] The gears have a face width [fw] and the overall length of the active portion of the spindle is [w4.] The drive spindle may also be fashioned using a long splined shaft or a single long gear having a face width with teeth engaging both toothed flanges. An alternative embodiment may use a first rotatable surface on the screen such as its outer perimeter or an outer perimeter of a flange, and a second rotatable surface on the spindle being a cylindrical surface which drives the screen by friction.

Although only one meshed pair of teeth between the drive spindle and the screen is sufficient to rotate the screen, this embodiment of a rotatable screen also has a third circular array of teeth and the drive spindle also has a fourth circular array of teeth on its second gear engageable with the circular array of teeth on the screen. The spacing distance [w2] of the first and second flange edges is less than distance [w3] between the front edges of the spur gears of the drive spindle so that when installing the screen it is convenient to engage the flange and gear furthest away from the aperture first and then slide the screen the rest of the way into the aperture in an install direction indicated by arrow [80] so that the front flange engages with the front gear at the end of this install motion. By engaging the rear teeth of the screen first, it may be assured that the front set of teeth will be in registration when the front toothed flange meets the front spur gear. The front plate and rear plate [5] of the housing preferably include interior facing counterbores which receive a portion of the face widths of the spur gears mounted on their spindles.

FIG. 10*d* shows an oblique right front view of a portion of an embodiment of a rotatable screen [12] having a plurality of flanges, engaged with an alternative embodiment of a drive spindle [71] which comprises both rollers and a gears as rotatable surfaces which rotate the drive surfaces of the screen. It is also within the scope of the invention to have rollers on the drive spindle contact the outer perimeter of the screen directly as a drum without flanges, however in the embodiment shown the screen has a front flange [78*a*] as a first rotatable surface, a rear flange [78*b*] as a second rotatable surface, and an intermediate or medial flange [78*c*] which is a toothed flange, while the front and rear flanges have smooth rims. The smooth rims may be fashioned to fit closely to the contour of the aperture of the housing, and be preferred for preventing processed material from escaping past the flange and possibly migrating out of the housing itself.

The drive spindle has a first front roller [75*a*] which rotates the front flange of the screen and a second rear roller [75*b*] which rotates the rear flange of the screen, and a third rotatable surface which is a spur gear [75*c*] which engages in teeth of the intermediate or medial flange of the screen. In an optional embodiment, the screen flanges may be buttressed and stabilized against warping by means of stabilizing columns or rods [86] running from the front flange through the intermediate flanges and to the rear flange. The rods may be threaded to seat in threaded apertures of the flanges or accept threaded fasteners to locate and stabilize the flanges. Alternatively and preferably, push nuts [88] are installed on the stabilizer rods and pressed up to the flanges to axially lock them in place. Push nuts may be used on smooth, unthreaded rods which are advantageously less costly and easier to clean.

Figure 10E:
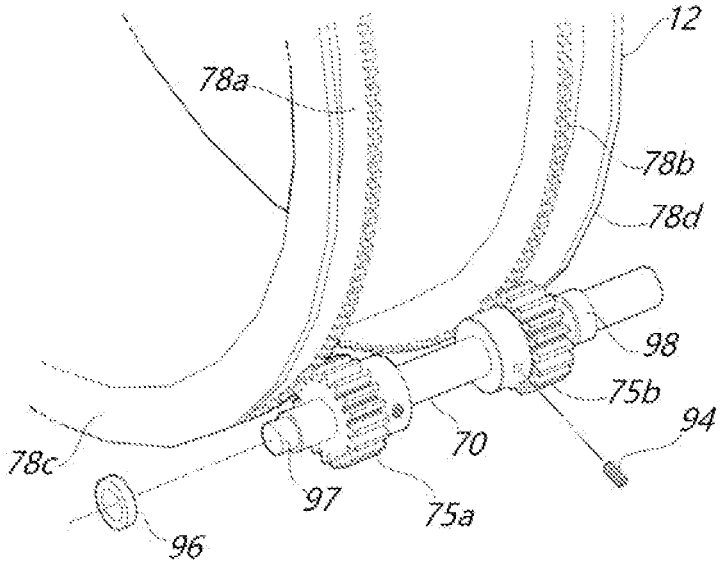
FIG. 10*e* shows an oblique right front view of a portion of an alternative embodiment of a rotatable screen having a plurality of flanges, engaged with an another alternative embodiment of a drive spindle which comprises gears as rotatable surfaces which rotate the screen.

FIG. 10*e* shows an oblique right front view of a portion of an alternative embodiment of a rotatable screen [12] having a plurality of flanges, engaged with an another alternative embodiment of a drive spindle which comprises gears as rotatable surfaces which rotate the screen. This version of a screen includes a front flange [78*c*] and a rear flange [78*d*] which have smooth rims. The front flange is closely fitted to the aperture in the first plate of the housing to help prevent disintegrated matter from migrating out through gaps between the housing and the door. The rear flange of the screen is closely fitted to the circular groove [36 of FIG. 3] in the second plate of the housing to help prevent material within the screen from escaping around the rear without being properly sized by the pores of the screen.

The drive spindle assembly in this embodiment includes a stepped shaft [70] with an end portion [97] of a smaller diameter than the rest of the shaft. A first bushing [96] or bearing fits onto this reduced diameter step. Bushings may be more suitable than bearings because the rotational speed is preferably slow, such as between 0.1 and 10 rpm. The other end of the shaft is supported by a second bushing [98.] A first flange [78*a*] and a second flange [78*b*] on the rotatable screen reside medial to the front and rear flanges, and are toothed flanges and further comprise first and third circular arrays of teeth respectively, and the drive spindle includes two spur gears [75*a*] and [75*b*] which respectively comprise second and fourth circular arrays of teeth respectively engageable with first circular arrays of teeth of the screen. The spur gears are preferable secured to the spindle shaft using angularly adjustable means such as set screws [94,] but other angularly adjustable means such as collets or Trantorque® keyless bushings are also included within the scope of the invention. In a best mode the teeth of each of the spur gears on the spindle are mutually aligned so that once any one of the toothed flanges is aligned and engages with its spur gear, then all other sets of flange teeth and gear teeth will fall into alignment during insertion of the screen into the housing.

Figure 10F:
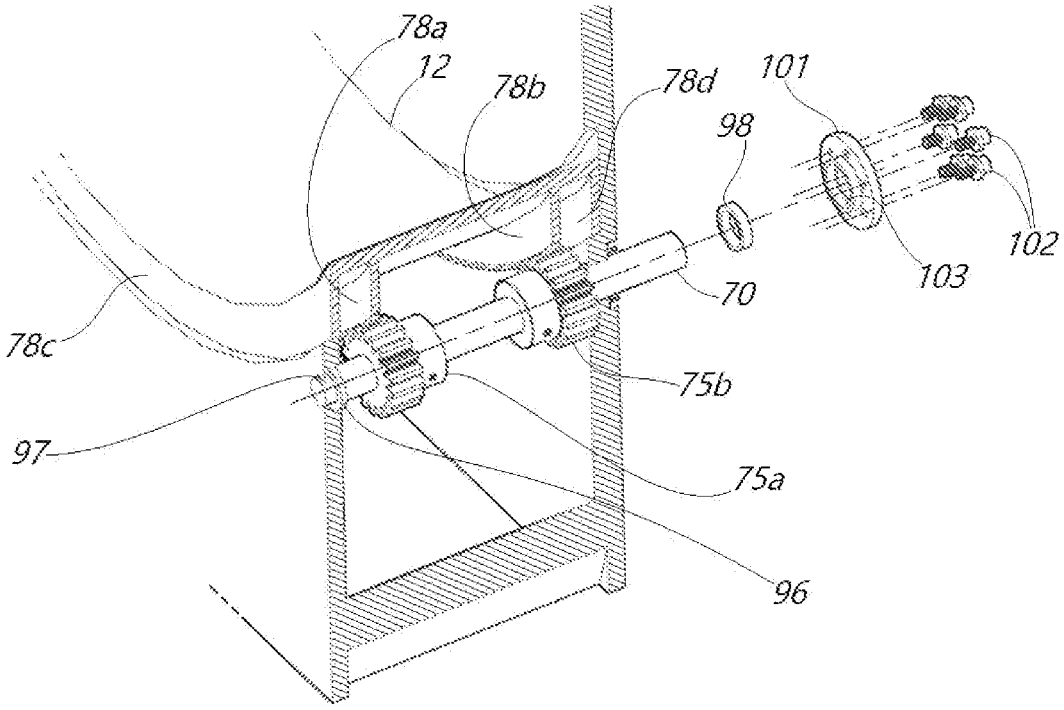
FIG. 10*f* shows an oblique right front view of a partial cross section of a housing, a screen, and a drive spindle in accordance with the embodiment of FIG. 10*e*, and also incorporating a seal flange.
Figure 10G:
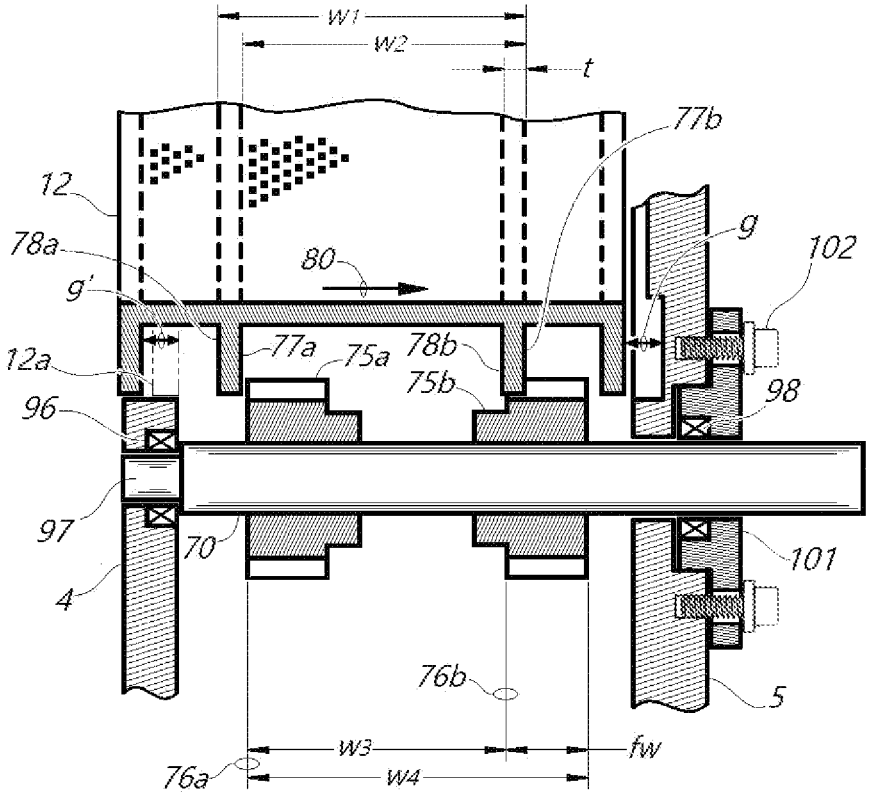
FIG. 10*g* shows a cross section of components of the embodiment of FIG. 10*e* taken at the section line B-B defined in FIG. 10*a*.

In FIGS. 10*f* and 10*g* the reference numerals for the smooth screen flanges, toothed screen flanges, spur gears, and the spindle shaft with its stepped portion and its bushings are the same as enumerated in FIG. 10*e*.

FIG. 10*f* shows an oblique right front view of a partial cross section of a housing, a screen [12,] and a drive spindle assembly in accordance with the embodiment of FIG. 10*e*, and also incorporating a seal flange [101] secured to the housing by fasteners [102.] For efficacy it is preferable that the fasteners seat into blind holes in the exterior of the housing. The seal flange includes a counterbore which receives the second bushing [98] or may also receive a redundant shaft seal. The interface between the flange and the housing may also incorporate a gland, an annular seal, or an o-ring seal.

FIG. 10*g* shows a cross section of components of the embodiment of FIG. 10*e* taken at the section line B-B defined in FIG. 10*a*. In this view the screen [12] is being inserted into the housing and its second flange [78*b*] is engaging rotatable surfaces of its third circular array of teeth into the fourth circular array of teeth which are rotatable surfaces residing on the second spur gear [75*b*] of the spindle shaft assembly. The insertion direction is shown by arrow [80,] and this engagement preferably occurs before the a second engagement of the rotatable surfaces of the first circular array of teeth residing on the first flange [78*a*] into rotatable surfaces of the second circular array of teeth residing on the first spur gear [75*a*] of the spindle shaft assembly. As the screen is installed, a gap [g] closes between the rear surface of the flange and a receiving surface of the circular groove in the interior of the second plate [5] of the housing. A similar gap [g'] closes as a rear surface of the front flange of the screen preferably comes into planar alignment with an interior surface of the first plate [4] of the housing when the screen seats in a position indicated by [12*a*.] In the seated position both spur gears are meshed with both toothed flanges residing somewhere within the face widths [fw] of the gear teeth.

With a flange thicknesses of a dimension [t,] an overall width between the first and second flanges of the screen dimension [w1,] and the first and second flange edges [77*a*] and [77*b*] axially spaced apart from the first flange edge by a first distance [w2,] the spur gears are spaced so that a distance from a first drive surface of a first gear having a first edge [76*a*] and a second drive surface of a second gear having a second edge [76*b*] is axially spaced apart from the first edge by a second distance [w3] with an overall length of the active portion of the spindle being [w4.]

It is advantageous that the spacing distance [w2] of the first and second flange edges is less than distance [w3] between the front edges of the spur gears of the drive spindle assembly so that when installing the screen it is convenient to engage the flange and gear furthest away from the aperture first and then slide the screen the rest of the way into the aperture by feel. By engaging the rear teeth of the screen first, it may be assured that the front set of teeth will be in registration when the front toothed flange meets the front spur gear as a blind insertion. The installation may proceed without having to visually confirm alignment of both sets of gears because once an alignment is made at the rear of the drive spindle assembly, the forthcoming alignment of the front sets of teeth is already assured.

Figure 11:
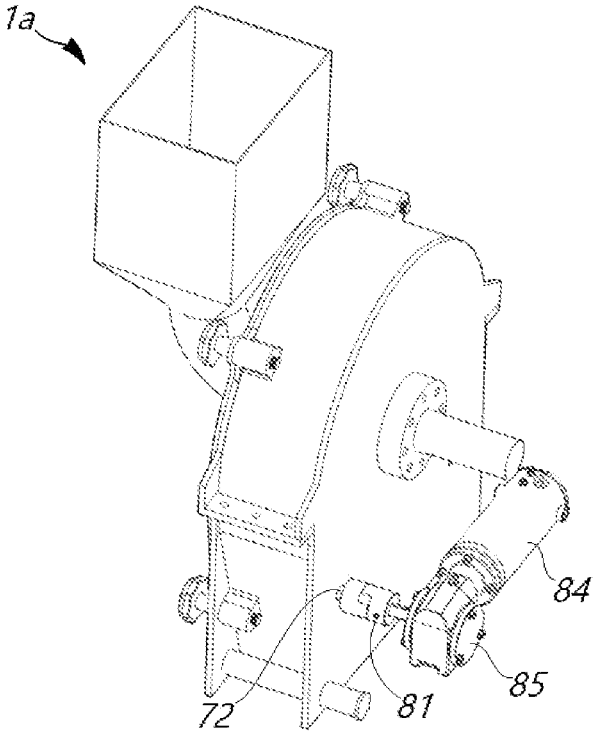
FIG. 11 shows a rear top right external view of a pin mill in accordance with the invention, having an attached hopper and a motor drive assembly for rotating a rotatable screen within the housing.

FIG. 11 shows a rear top right external view of a pin mill [la] in accordance with the invention, having an attached hopper and a motor drive assembly for rotating a rotatable screen within the housing. A motor drive [84] may be operably coupled to the shaft or its shaft extension [82] by means of a shaft coupler [81] which may also act as a dog clutch or a slip clutch to protect the motor from damage in a foreign object halts the rotating mill components abruptly. The drive motor may also, as shown, be operably coupled to the drive spindle through a reduction gear train [85.] The motor may be a stepper motor capable of reversing or of intermittent drive motions.

Figure 12A:
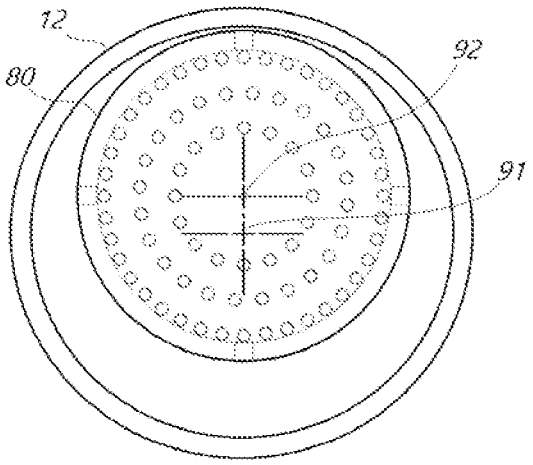
FIGS. 12*a*, 12*b*, and 12*c* show alternative embodiments within the scope of the invention in which the rotational axis of the screen is offset from the rotational axis of the rotor assembly.
Figure 12B:
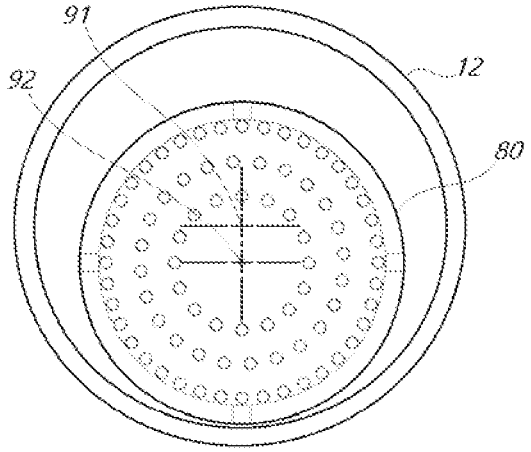
Figure 12C:
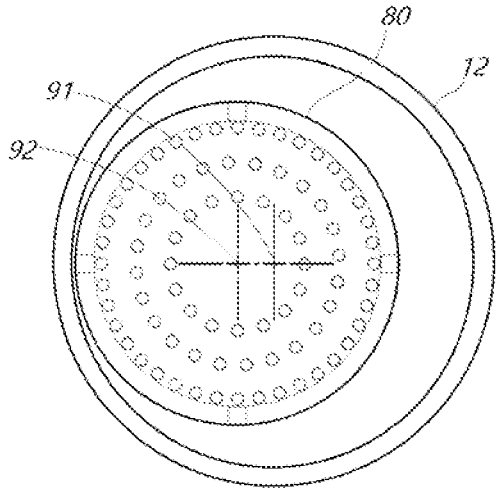

It is also contemplated within the scope of the invention that the axis of rotation of the rotor assembly need not be coaxial with the axis of rotation of the rotor assembly. FIGS. 12*a*, 12*b*, and 12*c* show alternative embodiments within the scope of the invention in which a first axis of rotation [91] of the screen [12] is offset from a second axis of rotation [92] axis of the rotor assembly [80] and its rotor disc. In FIG. 12*a* the screen rotational axis is below that of the rotor assembly, in FIG. 12*b* the screen rotational axis is above that of the rotor assembly, and in FIG. 12*c* the screen rotational axis is to one side of that of the rotor assembly. These embodiments may be preferred if it is desired to accumulate a larger mass of broken up particles of intermediate sizes not yet able to pass through the screen, such as by introducing charges of material through the hopper as a series spaced out in time so that the interval between charges is used to finish breaking up the material and passing it through the screen before introducing the next charge.

While certain features and aspects have been described with respect to exemplary embodiments, one skilled in the art will recognize that numerous modifications are possible. Also, while certain functionality is ascribed to certain system components, unless the context dictates otherwise, this functionality may be distributed among various other system components in accordance with the several embodiments.

Moreover, while the procedures of the methods and processes described herein are described in a particular order for ease of description, unless the context dictates otherwise, various procedures may be reordered, added, and/or omitted in accordance with various embodiments. Furthermore, the procedures described with respect to one method or process may be incorporated within other described methods or processes; likewise, system components described according to a particular structural configuration and/or with respect to one system may be organized in alternative structural configurations and/or incorporated within other described systems.

The present disclosure is not to be limited in terms of the particular embodiments described in this application, which are intended as illustrations of various aspects. Many modifications and variations can be made without departing from its spirit and scope. Functionally equivalent methods and apparatuses within the scope of the disclosure, in addition to those enumerated herein, are possible from the foregoing descriptions. Such modifications and variations are intended to fall within the scope of the appended claims. The present disclosure is to be limited only by the terms of the appended claims, along with the full scope of equivalents to which such claims are entitled.

Hence, while various embodiments are described with or without certain features for ease of description and to illustrate exemplary aspects of those embodiments, the various components and/or features described herein with respect to a particular embodiment may be substituted, added, and/or subtracted from among other described embodiments, unless the context dictates otherwise. Thus, unauthorized instances of apparatuses and methods claimed herein are to be considered infringing, no matter where in the world they are advertised, sold, offered for sale, used, possessed, or performed.

Consequently and in summary, although many exemplary embodiments are described above, it will be appreciated that the invention is intended to cover all modifications and equivalents within the scope of the following claims.

The invention claimed is:

1. A disintegrating mill comprising a housing defining an interior and an aperture, said housing further comprising at least one drive spindle rotatably mounted therein, a door for closing said aperture, said door hingeably coupled to a guide bar, a stator affixed to said door, said stator further comprising a plurality of radially spaced apart circular arrays of projections, a screen rotatable about a first axis of rotation deposited within said interior of said housing, with a rotatable surface of said drive spindle in contact with a rotatable surface of said screen, and a rotor disc defining a second axis of rotation, and having a perimeter and at least one vane knife affixed to said perimeter of said rotor disc, said vane knife comprising:

a cutting edge, a pressure surface having a concave surface and facing toward said axis of rotation and a suction surface having a convex surface and facing opposite said pressure surface, and an angle of attack for developing suction for inward pulling of particles stuck in said screen, said vane knife comprising first and second end plates and a midplate connected by a spine member rigidly spacing apart said end plates and midplate.

2. The disintegrating mill of claim 1, wherein said rotor disc further comprises second axis of rotation, and a plurality of radially spaced apart circular arrays of projections, such that with said aperture in said housing closed by said door, said circular arrays of projections of said stator and said circular arrays of projections of said rotor disc are concentric, and said stator and said rotor disc reside within said cylindrical screen.

3. The disintegrating mill of claim 2, wherein said rotor disc further comprises a hub and further comprises a back plate affixed to said hub and to at least one of said at least one vane knives.

4. The disintegrating mill of claim 2, wherein a projection from among any plurality of radially spaced apart circular arrays of projections comprises a cross section selected from the set of cross sections consisting of a regular polygon, an irregular polygon, a diamond, a triangle, a circle, an ovoid, an ellipse, a square, a rectangle, a rhombus, a trapezoid, a segment of a cylinder, a crescent and a segment of a hollow cylinder.

5. The disintegrating mill of claim 1, wherein said rotatable screen further comprises a first circular array of teeth and said drive spindle further comprises a second circular array of teeth engageable with said first circular array of teeth.

6. The disintegrating mill of claim 5, wherein said rotatable screen further comprises a third circular array of teeth and said drive spindle further comprises a fourth circular array of teeth engageable with said third circular array of teeth.

7. The disintegrating mill of claim 6, wherein said screen further comprises a first flange having a first edge and a second flange having a second edge axially spaced apart from said first edge by a first distance, and said drive spindle has a first drive surface having a first edge and a second drive surface having a second edge axially spaced apart from said first edge by a second distance less than said first distance.

8. The disintegrating mill of claim 1, wherein a portion of said screen is received within a circular groove in an interior surface of said housing.

9. The disintegrating mill of claim 1, further comprising a shaft seal, and wherein said rotor assembly is attached to a shaft passing through said shaft seal and an aperture in said housing.

10. The disintegrating mill of claim 1, further comprising an infeed hopper and a duct, and wherein said door further comprises an aperture, whereby said hopper communicates through said duct to said interior of said housing.

11. A disintegrating mill, comprising:

a rotatable screen having an inside diameter, a rotor assembly further comprising a shaft defining an axis of rotation, a rotor disc defining a perimeter and having a first plurality of radially spaced apart circular arrays of projections emerging therefrom, at least one vane knife affixed to said perimeter of said rotor disc, said vane knife comprising a cutting edge, a pressure surface having a concave surface and facing toward said axis of rotation and a suction surface having a convex surface and facing opposite said pressure surface, and an angle of attack for developing suction for inward pulling of particles stuck in said screen, said vane knife comprising first and second end plates and a midplate connected by a spine member rigidly spacing apart said end plates and midplate, said rotor assembly residing within said inside diameter of said screen;

a housing defining an interior and comprising a first plate having an aperture, a second plate, and a perimeter wall spanning between said first plate and said second plate, said perimeter wall further comprising an arcuate section and a gap;

at least one drive spindle rotatably mounted therein, a door guide spanning between said first plate and said second plate of said housing, a door guide bar slidingly coupleable to said door guide;

a door for closing said aperture in said housing, said door hingeably attached to an end of said door guide bar; and a stator having a second plurality of radially spaced apart circular arrays of projections emerging therefrom, said stator attached to said door so that with said door closed said first plurality of circular arrays radially alternate with said second plurality of projections.

12. The disintegrating mill of claim 11, wherein said rotor disc further comprises a hub, and said rotor assembly further comprises a back plate affixed to said hub and to at least one of said at least one vane knife.

13. The disintegrating mill of claim 11, wherein said rotatable screen further comprises a first circular array of teeth and said drive spindle further comprises a second circular array of teeth engageable with said first circular array of teeth.

14. The disintegrating mill of claim 13, wherein said rotatable screen further comprises a third circular array of teeth and said drive spindle further comprises a fourth circular array of teeth engageable with said third circular array of teeth.

15. The disintegrating mill of claim 14, wherein said screen further comprises a first flange having a first edge and a second flange having a second edge axially spaced apart from said first edge by a first distance, and said drive spindle has a first drive surface having a first edge and a second drive surface having a second edge axially spaced apart from said first edge by a second distance less than said first distance.

16. The disintegrating mill of claim 11, wherein a portion of said screen is received within a circular groove in an interior surface of said housing.

17. The disintegrating mill of claim 11, further comprising a shaft seal, and wherein said rotor assembly is attached to a shaft passing through said shaft seal and an aperture in said housing.

18. The disintegrating mill of claim 11, further comprising an infeed hopper and a duct, and wherein said door further comprises an aperture, whereby said hopper communicates through said duct to said interior of said housing.

19. The disintegrating mill of claim 11, wherein a projection from among any plurality of radially spaced apart circular arrays of projections comprises a cross section selected from the set of cross sections consisting of a regular polygon, an irregular polygon, a diamond, a triangle, a circle, an ovoid, an ellipse, a square, a rectangle, a rhombus, a trapezoid, a segment of a cylinder, a crescent and a segment of a hollow cylinder.

* * * * *